US005643036A

United States Patent [19]

Liu et al.

[11] Patent Number: 5,643,036

[45] Date of Patent: Jul. 1, 1997

[54] TOY VEHICLE AND ENERGIZER-LAUNCHER

[75] Inventors: Dexter Chih-Teh Liu, Portsmouth, R.I.; Douglas Melville, Jr., Simsbury, Conn.

[73] Assignee: LCD International, L.L.C., Newport, R.I.

[21] Appl. No.: 342,294

[22] Filed: Nov. 18, 1994

[51] Int. Cl.[6] ..... A63H 17/045; A63H 29/00; A63H 29/02

[52] U.S. Cl. ..... 446/23; 446/429; 446/462; 446/463; 464/38

[58] Field of Search ..... 180/165; 464/16, 464/30, 37, 38, 147, 154; 446/22, 23, 429, 430, 435, 440, 457, 461, 462, 463, 465, 486

[56] References Cited

U.S. PATENT DOCUMENTS

| | | | |
|---|---|---|---|
| 2,788,613 | 4/1957 | Gelfand et al. . | |
| 2,829,467 | 4/1958 | Pagano | 446/440 X |
| 3,228,209 | 1/1966 | Hersey | 464/38 X |
| 3,504,208 | 3/1970 | Rivers . | |
| 3,757,459 | 9/1973 | Buck et al. . | |
| 3,798,832 | 3/1974 | Terzian . | |
| 3,886,682 | 6/1975 | Ieda et al. . | |
| 3,932,956 | 1/1976 | Young | 464/37 X |
| 4,052,927 | 10/1977 | Flatau | 89/1.5 R |
| 4,135,328 | 1/1979 | Yamasaki . | |
| 4,141,256 | 2/1979 | Wilson et al. . | |
| 4,201,011 | 5/1980 | Cook | 446/440 |
| 4,267,661 | 5/1981 | Hanson . | |
| 4,330,127 | 5/1982 | Brand et al. | 273/86 B |
| 4,363,186 | 12/1982 | Goldfarb et al. . | |
| 4,463,515 | 8/1984 | Barlow et al. . | |
| 4,483,096 | 11/1984 | Gabler et al. . | |
| 4,498,886 | 2/1985 | Goldfarb et al. . | |
| 4,501,567 | 2/1985 | Cathell . | |
| 4,526,554 | 7/1985 | Goldfarb et al. . | |
| 4,529,389 | 7/1985 | Kennedy et al. | 446/429 X |
| 4,556,396 | 12/1985 | Kennedy et al. . | |
| 4,571,212 | 2/1986 | Kakizaki | 446/23 X |
| 4,678,452 | 7/1987 | Nelson et al. | 464/38 |
| 4,702,122 | 10/1987 | Richard | 464/37 X |
| 4,732,569 | 3/1988 | Hippely et al. . | |
| 4,740,001 | 4/1988 | Torleumke . | |
| 4,811,603 | 3/1989 | Bitetti . | |
| 4,946,417 | 8/1990 | Ishikawa et al. | 446/430 |
| 4,973,905 | 11/1990 | Neidhardt | 324/164 |
| 5,129,852 | 7/1992 | Crisci et al. . | |

FOREIGN PATENT DOCUMENTS

| | | | |
|---|---|---|---|
| 2119266 | 11/1983 | United Kingdom | 446/462 |
| 2248191 | 4/1992 | United Kingdom | 446/463 |

*Primary Examiner*—Robert A. Hafer
*Assistant Examiner*—D. Neal Muir
*Attorney, Agent, or Firm*—Panitch Schwarze Jacobs & Nadel, P.C.

[57] ABSTRACT

A toy vehicle has a drive wheel and a flywheel that are coupled together by a slip clutch which includes a flexible pawl extended from the drive wheel to the surface of the flywheel so that the drive wheel may be grasped and brought to an immediate stop without injury. The toy vehicle cooperates with the energizer-launcher so that the toy vehicle is spring catapulted therefrom upon release thereof. The energizer-launcher has a pistol grip handle with trigger for one-handed aiming and launching of the vehicle and a pull cord for accelerating the flywheel and drive wheel while the launcher is being held by the pistol grip handle. A tachometer may be provided on the energizer-launcher. The toy vehicle further may have a spark generator on the drive wheel which is activated by the rotation of the drive wheel after the vehicle is launched.

10 Claims, 7 Drawing Sheets

TOY VEHICLE AND ENERGIZER-LAUNCHER

FIELD OF THE INVENTION

The present invention relates to toy vehicles and, in particular, those having a drive wheel and a flywheel and adapted to mate with a launcher mechanism having means for energizing the flywheel.

BACKGROUND OF THE INVENTION

Toy vehicles have achieved a wide popularity in the consumer market, especially as children's toys, and are configured to simulate a broad category of full-sized vehicles including but not limited to motorcycles, racing cars, and trucks. Typically, such toy vehicles are unpowered or powered by spring, inertia or battery powered motors. However, a small group of such toy vehicles have been powered by flywheels which are in the form of drive wheels or are coupled in some way, typically gearing, to a drive wheel or wheels.

Such flywheel equipped toy vehicles are commonly energized and released from a launching mechanism that includes a platform, such as that described in either U.S. Pat. Nos. 3,886,682 ('682) or 4,498,886 ('886), whereby a toy vehicle is propelled down an inclined ramp and in a preselected direction. Children commonly use the combination toy vehicle and launcher mechanism in pursuit of competitive games won by the child that launches the toy vehicle so that it moves the furthest distance or ends up the closest to a selected target on a simulated racing surface. The experience of releasing the toy vehicle from the launcher may be enhanced in a manner similar to a drag race event, wherein the speed (revolutions per minutes (RPM)) of the engine of the drag racer has achieved a relatively high RPM before the drive wheels are engaged initiating the drag race.

In any game participated in by children, the factors that may scare or even cause physical harm to the child should be taken into account, as well as any ensuing damage to the child's play area. For example, if a toy vehicle is launched but in the wrong direction, a child may quickly capture or attempt to pick-up the toy vehicle in an effort to re-direct it along its proper path, even though the wheels of the toy vehicle are still rotating and at a considerable speed. For such a situation, the rotating wheels may come into contact and hit or rub against the hand of the child and, therefore, may cause some possible bruises or abrasions to the child's fingers or may more likely cause the child to drop the toy vehicle, thereby, possibly damaging the surface serving as a roadway for the toy vehicle. The prior toy vehicles and associated launcher mechanisms, while having selected benefits, seem to be specifically lacking in providing a toy vehicle having either an exposed flywheel or flywheel driven road wheel that can be safely brought to a halt when grabbed by a child or striking an object while rotating at high speed. It would be desirable to provide a flywheel equipped toy vehicle in which a rotating road vehicle comes to a complete stop, while avoiding serious injury to a child grabbing the wheel and damage to the surface serving as the roadway.

Further, the prior art devices also seem to generally fail in providing a toy vehicle and launcher combination that allows the toy vehicle to be easily released from the launcher other than with the launcher firmly planted on the ground or other support surface. Such devices are usually designed in a way that also requires the user to hold or press the launcher against the support surface to operate the mechanism accelerating the flywheel. Such restrictions on the use of these toys limit their entertainment value to children.

SUMMARY OF THE INVENTION

Briefly stated, the invention is, in one aspect, a toy vehicle comprising: a rotatably mounted axle, at least one drive wheel mounted on said axle for rotation; a flywheel mounted on said axle for rotation and disposed in said drive wheel; only one of the drive wheel and the flywheel being fixed to the axle so as to rotate as one with the axle; and a slip clutch drivingly coupling together the drive wheel and the flywheel.

In another aspect, the invention is a mechanical clutch for rotatably connecting and disconnecting an associated flywheel and drive wheel of a toy vehicle. The mechanical slip clutch comprises a flexible pawl on one of the drive wheel and the flywheel extending from the one wheel to the remaining one of the drive wheel and the flywheel; and a surface fixedly coupled with the remaining one of the drive wheel and the flywheel, the surface being textured sufficiently to be drivingly engaged by at least a distal tip of the flexible pawl when a torque of a sufficiently low magnitude is being transmitted between the pawl and the textured surface and to allow the at least one distal tip to slip over the textured surface when a torque of a sufficiently great magnitude is to be transmitted from one of the flexible pawl and the textured surface to a remaining one of the flexible pawl and textured surface.

In another aspect, the invention is a toy vehicle comprising: a chassis; an axle coupled with the chassis; a ground contacting wheel rotatably coupled with the chassis on the axle; a sparking wheel having an abrasive surface fixedly coupled with at least one of the axle and the ground contacting wheel for rotation on the vehicle; and an arm pivotally coupled with the chassis and having one end biased against the abrasive surface, the one arm carrying a material that produces a spark when rubbed against the abrasive surface.

In another aspect, the invention is an inertia energizer and launcher for a toy vehicle having a driven member exposed sufficiently to be engaged and rotated, said inertia energizer and launcher comprising: a draw string attached to a spool coupled to a recoil spring; a gear set having an output member exposed sufficiently to engage the driven member of the toy vehicle; a unidirectional clutch rotatably coupling the spool with the gear set only when the draw string is pulled; and a tachometer coupled with the gear set.

In another aspect, the invention is an inertia energizer and launcher for use with a toy vehicle, said inertia energizer and launcher comprising: a housing configured to receive the toy vehicle and having a one-handed grip portion; a draw string attached to a spool coupled with a recoil spring, the draw string being supported from the housing so as to be grasped and pulled by a user holding the one-handed grip portion; a gear set; an output member coupled with the gear set and exposed sufficiently to engage the driven member of the toy vehicle when the vehicle is received by the housing; and a unidirectional clutch rotatably coupling the spool with the gear set only when the draw string is pulled.

BRIEF DESCRIPTION OF THE DRAWINGS

The foregoing summary, as well as the following detailed description of the present and preferred embodiment(s) of the invention, will be better understood when read in conjunction with the appended drawings. For the purpose of illustrating the invention, there is shown in the drawings an embodiment which is presently preferred. It should be understood, however, that the present invention is not limited to the particular arrangements and instrumentalities shown.

In the Drawings.

DETAILED DESCRIPTION OF THE PREFERRED EMBODIMENTS

Figure 1:
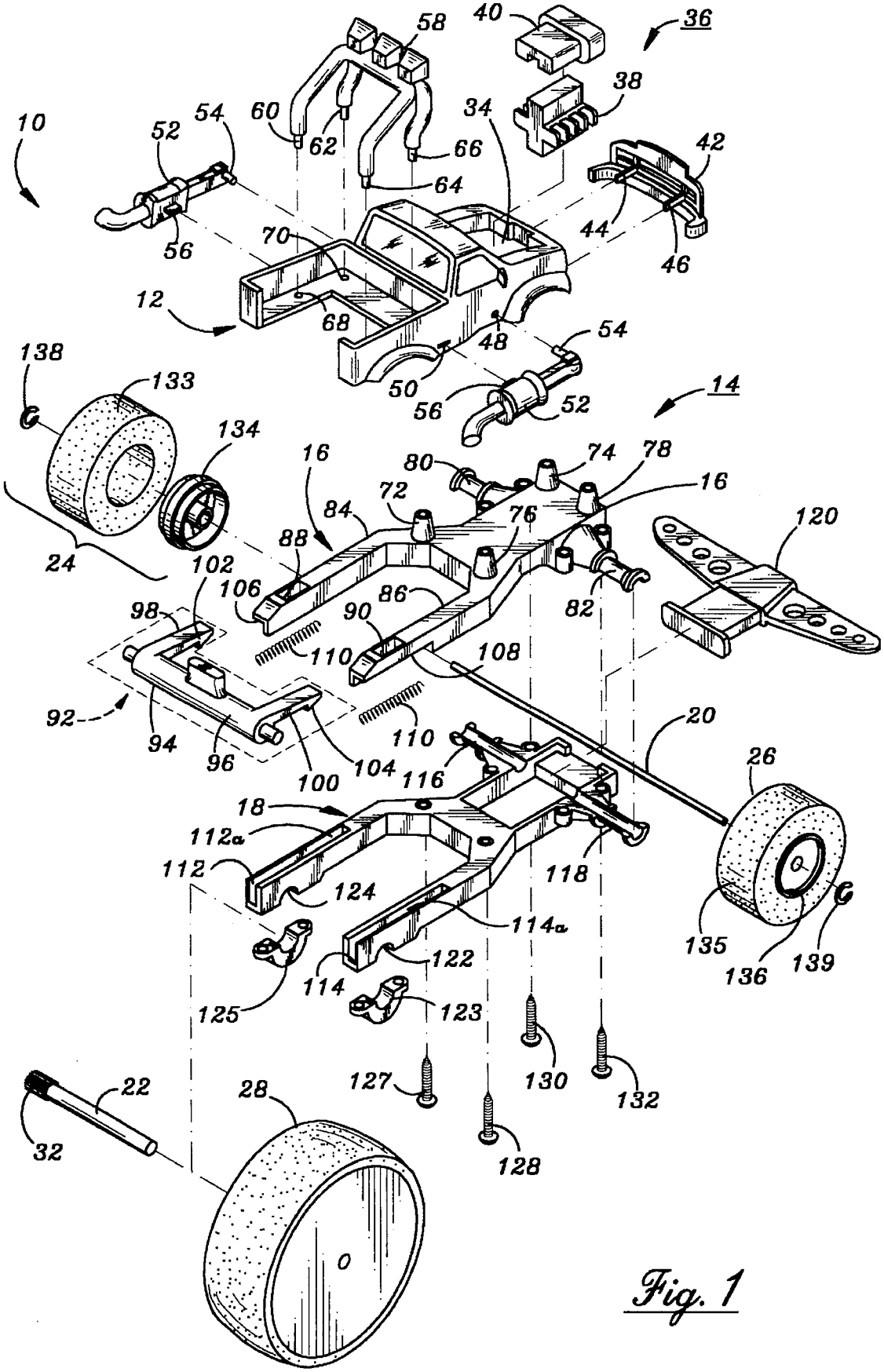
FIG. 1 is an exploded view of a toy vehicle of the present invention.

With reference to the drawings, wherein like numerals indicate like elements, there is shown in FIG. 1 an exploded view of a toy vehicle indicated generally at 10, which is configured to simulate a truck having a relatively large, centrally and rearwardly located drive wheel 28. Although a truck is illustrated in FIG. 1, the principles of this invention are equally applicable to other vehicles such as racing cars or even motorcycles. The toy vehicle 10 of FIG. 1 preferably comprises plastic components, except for metallic spring and screw elements to be described, but may be comprised of metallic, wooden, ceramic or composite components. The toy vehicle 10 is shown by an exploded view, but the elements may be brought together by following the paths of the unnumbered, broken directional lines. The toy vehicle 10 is particularly suited for use by children in pursuit of self-entertaining or competitive games, some of which include propelling the toy vehicle 10 from an inertia energizer and launcher to be described with reference to FIG. 3.

The toy vehicle 10 of FIG. 1, comprises a body 12, a chassis 14 formed by an upper member 16 and a lower member 18, a front axle 20 supported within the toy vehicle 10, a rear axle 22 rotatably mounted within the toy vehicle 10, front wheels 24 and 26 that are rotatably mounted on or rotatably mounted with the front axle 20, at least one drive wheel 28 mounted on the rear axle 22 for rotation, and a gear 32 fixed to the rear axle 22.

The truck body 12 has an opening 34 in its front end that accepts a motor assembly indicated generally at 36 and comprising a motor 38 and a covering 40 preferably having a chromed exposed surface. The front end of the truck body 12 also has openings (not shown) that accept a front grill 42 having projecting mounting members 44 and 46. The projecting members 44 and 46 (as well as other insertable members) are preferably accepted by the toy vehicle 10 in a snap-lock manner provided by the selected dimensioning of the extending members and their complementary opening or can be locked in place by pinch nuts. Both sides of the truck body 12 have openings 48 and 50 (only shown for one side) that accept simulated exhaust pipes 52 (shown for both sides) respectively by way of projecting mounting members 54 and 56. The bed of the truck body 12 receives a roll cage 58 having projecting mounting members 60, 62, 64 and 66 that are inserted into four openings (only two openings 68 and 70 are shown).

The chassis upper member 16 has channel structure 80 and 82 that extend transversely outwardly, in opposing directions, from the front portion thereof to receive and partially cover the front axle 20. The upper chassis member 16 also has spaced-apart, longitudinally extending parallel members or arms 84 and 86 having detentes 88 and 90, respectively, at one of their ends that operatively cooperate with a latch 92 (indicated in phantom) of the inertia energizer and launcher, which is to be described with reference to FIG. 3. The latch 92 has shoulders 94 and 96 that are respectively interconnected with arms 98 and 100 10 which, in turn, have hook portions 102 and 104 that respectively engage the detents 88 and 90 of longitudinal members 84 and 86.

Longitudinal members 84 and 86 respectively have lower channels 106 and 108, each of which accepts and provides a partial housing for a compression coil spring 110, with the remainder of the spring housings being respectively provided by channels 112 and 114 in the lower chassis member 18. The lower chassis member 18 and upper chassis member 16 are brought together allowing the respective springs 110 to occupy both channel pairs 106 and 112 and 108 and 114. The channel pairs 106 and 112, and 108 and 114 are dimensioned to respectively provide slots 112A and 114A, lower defining edges of which are indicated by those reference numerals, which allow for the engagement of the respectively housed spring 110. During the assembly of the toy vehicle 10 and before the upper and lower chassis members 16 and 18 are brought together, the front axle 20 is preferably placed in grooves formed in opposite members 116 and 118, that transversely extend from the front portion of the lower chassis member 18 and that respectively merge with and correspond to oppositely extending transverse members 80 and 82 of the upper chassis member 16. The front end of the lower chassis member 18 also accepts a bumper 120.

The lower chassis member 18 is provided with cutouts 122 and 124 that are closed off by bracket members 123 and 125, which are attached, preferably by screws (not shown), to the lower chassis member 18. The lower chassis member 18, the upper chassis member 16, and the truck body 12 are brought together and fixed to each other by means of screw members 127, 128, 130 and 132, which pass through openings in the chassis lower member and in mounting members 72, 76, 74 and 78 to engage bosses (not depicted) within the body 12 to hold the body 12 and chassis members 16, 18 together.

The front wheel 24 includes a tire 133 preferably frictionally engaged with a hub 134 which, in turn, freely rotates about the front axle 20. Similarly, the front wheel 26 includes a tire 135 frictionally engaged with a hub 136, which freely rotates about the front axle 20. Wheels 26 and 28 are rotatably secured on axle 20 by C-rings 138 and 139 affixed thereto. The arrangement of the drive wheel 28 relative to the rear axle 22 is further described with reference to FIGS. 2 illustrating a preferred embodiment of the coupling of the drive wheel 28 and flywheel 30 to the rear axle 22.

Figure 2:
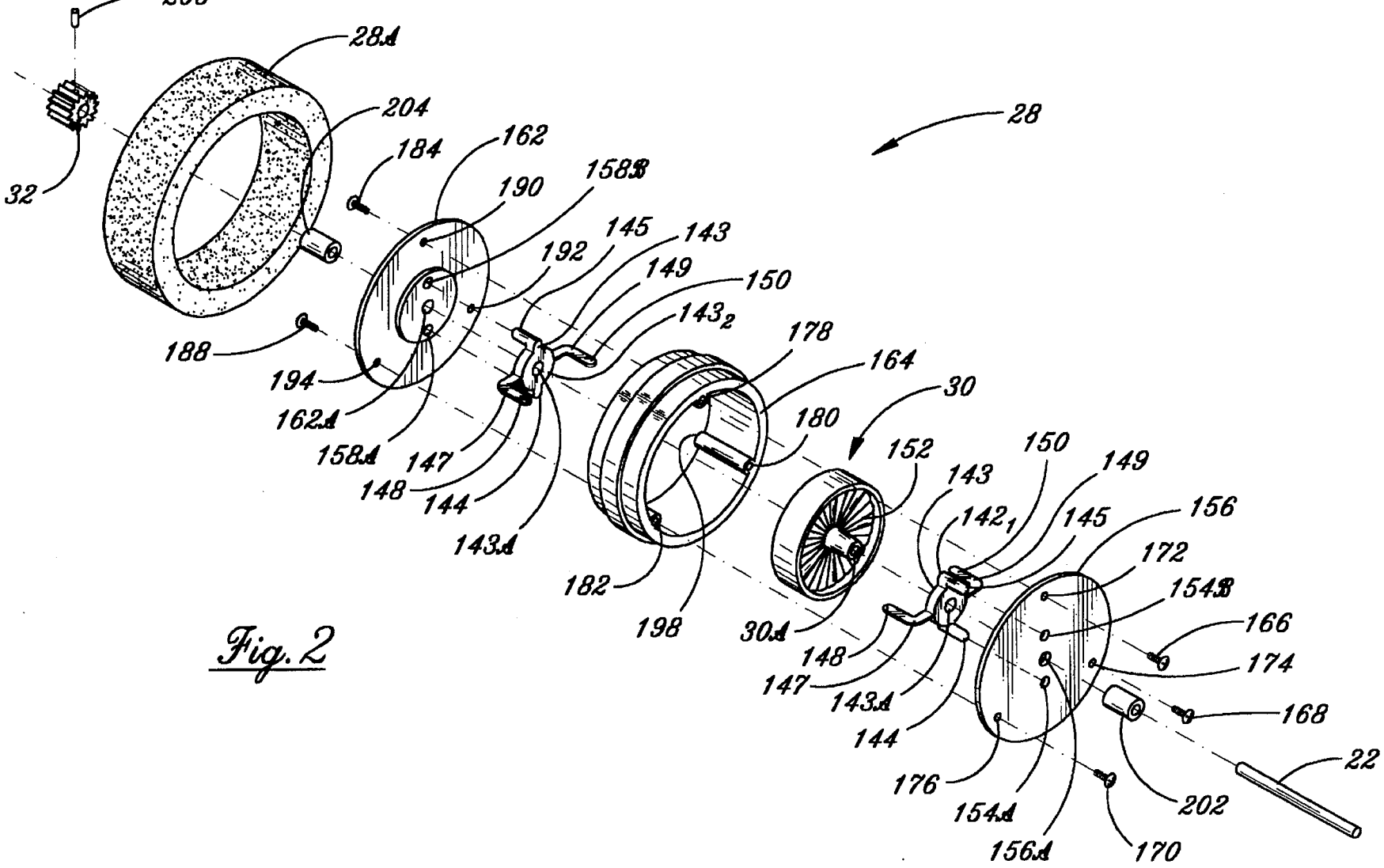
FIG. 2 is an exploded view of the drive wheel and flywheel of FIG. 1.

The drive wheel 28 of FIG. 2 includes a slip clutch which comprises at least one, and preferably two clutch members $142_1$ and $142_2$, each having a base 143 with an opening 143A dimensioned to fit over the rear axle 22. Each of the clutch members $142_1$ and $142_2$ further comprises anchor tabs 144 and 145 that are preferably integrated therewith and extend a first predetermined distance from the base 143 in a first direction. Each of the clutch members $142_1$ and $142_2$ further comprises a pair of flexible pawls 147, 149 extending from the base a second predetermined distance in a second direction, which is transverse to the first direction, and having two opposite distal tips 148 and 150 that either engage by contact (interference, friction or both) or slip over an opposing textured surface of the flywheel 30. Flywheel surface 152 facing clutch member $142_1$, is textured. It is presently preferred that surface 152 be being provide being provided with a multiplicity of radially extending pleats. Surface 152 may be textured in other ways, for example, by being molded with a rough matte or pebbled surface or having a high friction coefficient layer laminated or adhered to the side of the flywheel. The opposing side of flywheel 20 is preferably identically textured to be operatively engaged by clutch member $142_2$.

The anchor tabs 144 and 145 of the clutch member $142_1$ on one side of the flywheel 30 are inserted into and engaged by openings 154A and 154B of a right-side hub cap 156, whereas the anchor tabs 144 and 145 of the other clutch member $142_2$ are inserted into and engaged by openings 158A and 158B of a left-side hub cap 162. The right hub cap 156 is connected to a main hub rim 164 preferably by means of screws 166, 168 and 170 that are respectively inserted through openings 172, 174 and 176 of the right hub cap 156 so as to be captured and threadedly engaged by openings 178, 180 and 182, respectively, of the main hub rim 164. The left hub cap 162 is connected to the main hub rim 164 by means of screws 184 and 188 and a screw (not shown) opposite screw 168 that are respectively inserted through openings 190, 192 and 194 of the left hub cap 162 so as to be captured and threadedly engaged by openings (not shown) opposite openings 178 and 182, and an opening 198 (partially shown), respectively, of the main hub rim 164.

Figure 3:
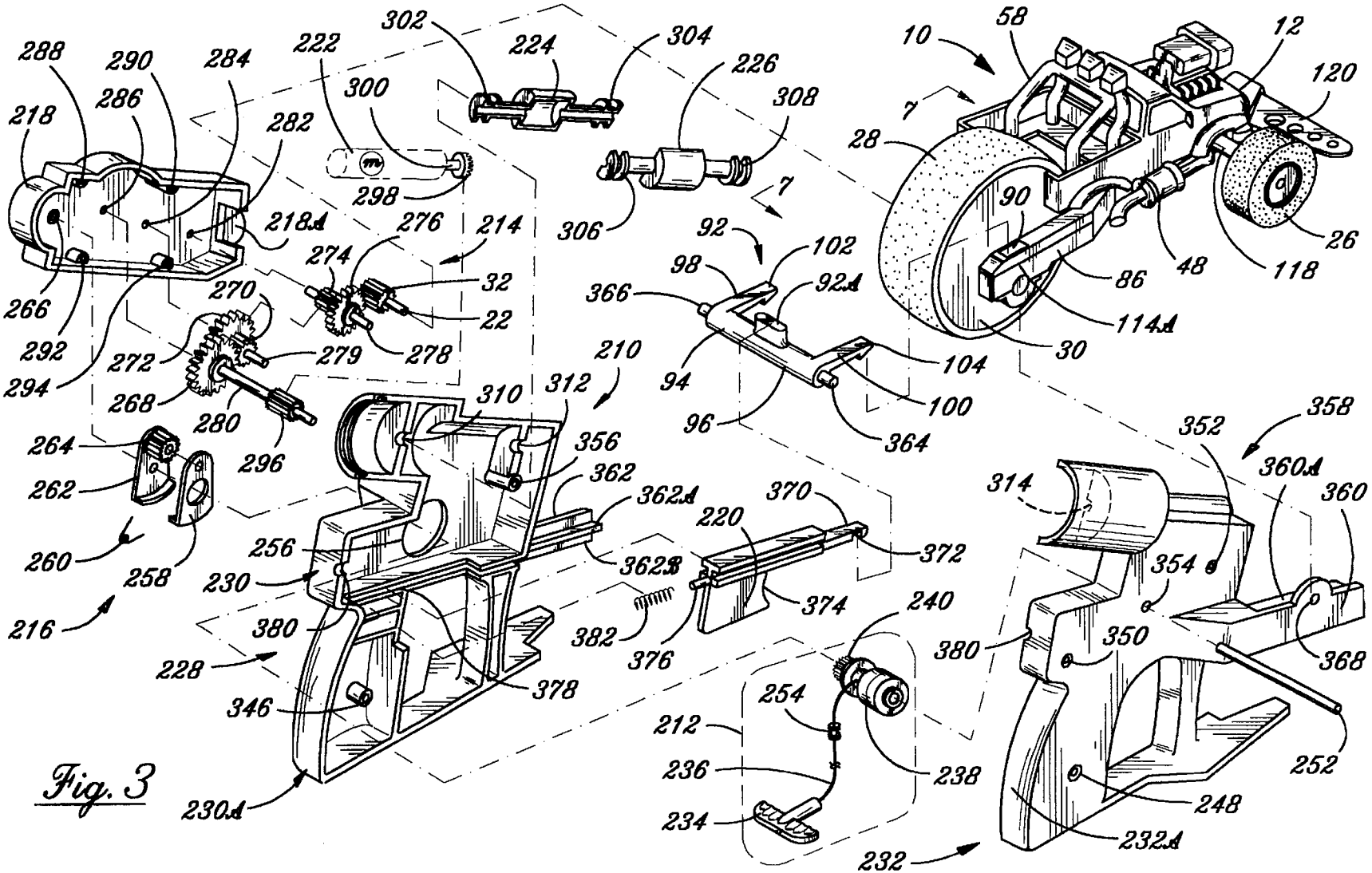
FIG. 3 is a substantially exploded view of an inertia energizer and launcher of the present invention with the toy vehicle of FIG. 1.

The drive wheel 28 is coupled to the rear axle 22 through the clutch members $142_1$, $142_2$ and the flywheel 30, which is itself preferably fixedly secured to the rear axle 22 for common rotation by suitable conventional means such as by being press fitted or adhered to or molded on axle 22. Though not depicted, the portion of the axle 22 received in the flywheel central opening 30A may be stamped or forged to form axial extending striations (grooves) to better engage with the flywheel 30. The drive wheel 28 is thereafter assembled on axle 22 around flywheel 30. Bearings 202 and 204 are mounted on axle 22 adjoining the outer sides of the right and left hub caps 156 and 162. The bearings 202 and 204 are captured between cutouts 122, 124 and brackets 123 and 125, respectively to rotatably support rear axle 22 from chassis 14. The connection of the left and right side hub caps 156 and 162 to the main hub rim 164 causes the drive tire 28A, which is rigidly attached to the main hub rim 164 by a frictional or adhesive connection, to be rotated as the rim 164 is rotated. Gear 32, which is left exposed on the side of wheel 28 so as to be coupled with the inertia energizer and launcher of FIG. 3, is connected to the rear axle 22 by means of a set screw 206. The gear 32 is a relatively small spur gear or pinion. For the embodiment of FIG. 2, the flywheel 30, the pinion 32 and the rear axle 22 are fixedly secured to one another to have a fixed relationship relative to each other.

The parameters of the clutch assemblies 142, including the textured surfaces 152, are selected so that each of the distal tips 148 and 150 of the flexible pawls 147, 149 of each clutch member $142_1$ or $142_2$ drivingly engages the textured surface 152 when a torque of a sufficiently low magnitude is being transmitted from the flywheel 30 to drive wheel 28 and, more particularly, from the flexible pawls 147, 149 of members $142_1$ and $142_2$ to the textured surfaces 152 so as to provide engagement therebetween and, conversely, does not engage the textured surfaces 152 but slips over those surfaces when a torque more particularly, sufficiently great in magnitude is being transmitted from the flexible pawls 147, 149 of clutch members $142_1$ or $142_2$ to the texture surface 152. The torques that are required for engagement and non-engagement between the flexible pawls and textured surfaces are selected so as to fit the needs of the toy vehicle 10, particularly with regard to the manipulation and capturing of the toy vehicle 10 by a child.

As discussed in the "Background" section, it is desired that a child be able to capture a moving toy vehicle without having any rotational member causing any injury to the child or without creating any sensation that would alarm the child and cause him or her to drop the toy vehicle 10. For the embodiments shown in FIGS. 1–3, when the child attempts to capture the toy vehicle to reorient its direction of movement (in a manner described in the "Background" section), he or she will more than likely contact the relatively large drive wheel 28. Furthermore, when the child attempts to capture the moving toy vehicle she or he will most likely grab the relatively large drive wheel 28 then acting as a rolling body having rotational inertia. In the event of such a capture by the child, the mechanical clutches of the present invention allow 142 the rotating drive wheel 28 to be brought to an immediate halt while substantially confining the rotational inertia and energy to the flywheel 30.

In addition to taking into account the desired maximum torque quantities to be transmitted between the pawls of the clutch members $142_1$ and $142_2$ and the textured surfaces 152, the parameters of the clutch members $142_1$ and $142_2$ and textured surfaces 152 are preferably selected so that the clutch assemblies 142 and surfaces 152 serve as a sonorous device. More particularly, these parameters are preferably selected so that the clutch members 142, and $142_2$ make a sound simulating the sound of an engine as the distal tips 148 and 150 of the flexible pawls 147 and 149 sweep across the opposing textured surface 152. This simulated sound may be a clicking sound whose repetition increases with the speed of the flywheel 30, especially as the toy vehicle 10 is being powered up by inertia energizer and launcher 210 that is now described with reference to FIG. 3.

FIG. 3 is an exploded view of a preferred inertia energizer and launcher of the present invention, indicated generally at 210. FIG. 3 illustrates the assembled toy vehicle 10 as being detached from the launcher 210. In actuality, and as will be further described with reference to FIGS. 7 and 8, the toy vehicle 10 is initially latched to the inertia energizer and launcher 210 so as to be powered up and is catapulted from the inertia energizer and launcher 210 upon release. The inertia energizer and launcher 210 supports the toy vehicle 10 so that its drive wheel 28 is out of contact with the launcher 210 and in an elevated position above the surface supporting the inertia energizer and launcher 210 and also preferably at a higher elevation than the elevation of the front wheels 24 and 26 of the toy vehicle 10. The elevated position of the drive wheel 28 allows the inertia energizer portion of the inertia energizer and launcher 210 to impart rotation to the flywheel 30 and from flywheel 30 to the drive wheel 28 so that toy vehicle 10 may be released therefrom with its drive wheel 28 already spinning at a desired RPM, thereby, allowing the toy vehicle 10 to propel itself in the direction in which it was aimed by a child manipulating the inertia energizer and launcher 210.

The inertia energizer and launcher 210 comprises a draw string mechanism indicated generally in phantomed box 212, a gear set or train indicated generally at 214, a unidirectional clutch indicated generally at 216, a cover 218 for holding and enclosing the unidirectional clutch 216 and the gear set 214, a movable trigger 220, a tachometer assembly indicated generally at 222, which is lodged in complementary enclosure members 224 and 226, and a housing 228 having two complementary half sections 230 and 232.

Figure 4:
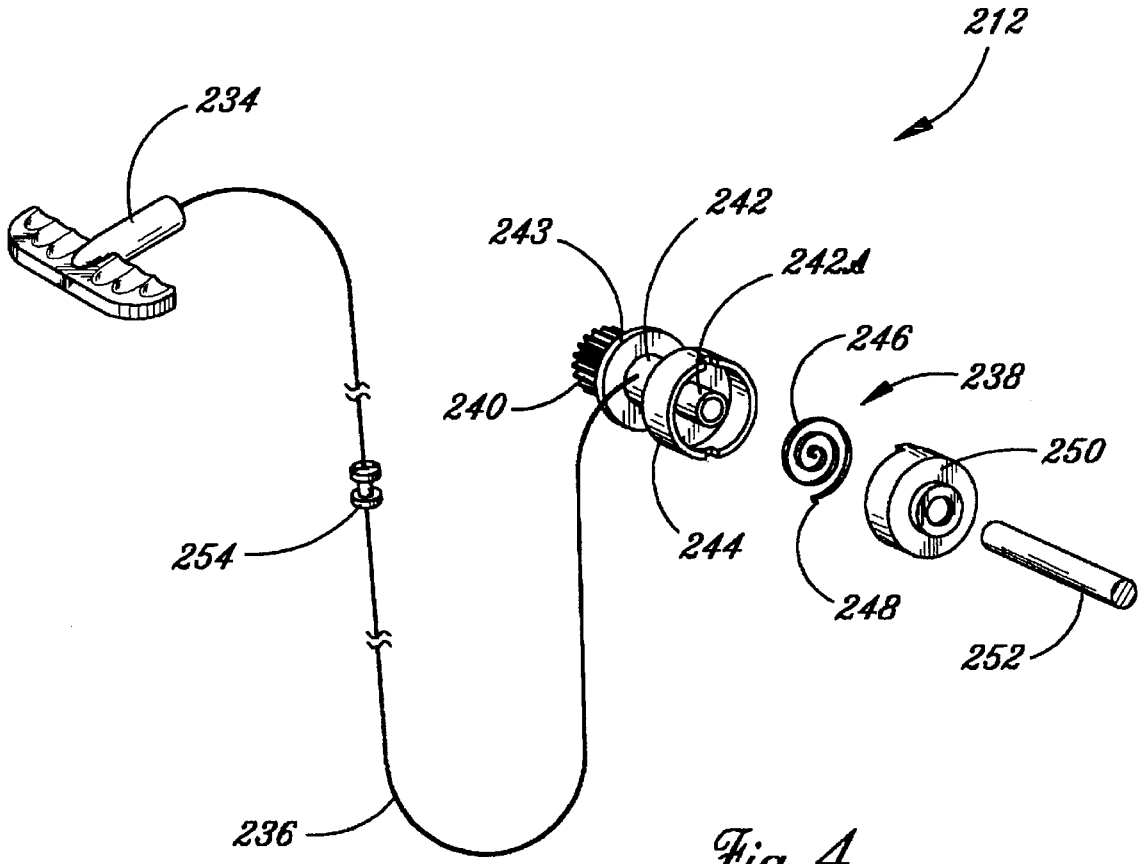
FIG. 4 is a partially exploded view illustrating details of a draw string mechanism of FIG. 3.

The lower rear portions 230*a* and 232*a* of sections 230, 232 form mating halves of a pistol grip as shown or other one-handed grip portion and further movably receive and support the trigger 220. The draw string mechanism 212 comprises a T-shaped handle 234, a draw string 236 with grommet 254, a pulley assembly indicated generally at 238 and a main power drive gear 240. The draw string mechanism 212 is further shown in FIG. 4 which illustrates the pulley assembly 238 as comprising a spool 242 that has the main power gear 240 attached thereto, a mounting plate 243 between the gear 240 and spool 242, a recoil spring 246 having a tab end 248 that mates with and engages spring cover section 244 and a mating spring cover section 250. A hollow shaft 242A has one end coupled to the main power gear 240 and a second end that extends from the spool 242 and through spring cover section 244 and spring 246 to cover section 250. Spool 242 is secured with or to one end of shaft 242A so as to rotate with that shaft. A remaining end of shaft 242A is coupled with spring 246. A rod 252 axially interconnects and rotatably supports the elements of the pulley assembly 238.

The draw string 236 and handle 234 hang from the rear of the launcher housing 228, centered behind and above the pistol grip 230*a*, 232*a*. This arrangement permits the user to grip the launcher with either hand by means of the pistol grip and simultaneously grip and operate the draw string handle 234 with the remaining hand.

In operation, the draw string 236 is wound around the spool 242 in a first direction and the recoil spring 246 is coiled about the shaft 242A in an opposite direction with the net effect being that when pulled, the draw string 236 pulls against the bias of the recoil spring 246. When the draw string 236 is released, the recoil spring 246 causes the draw string 236 to be re-wrapped around the spool 242. As will be further described, the rotation of the main power drive gear 240 is passed through gear set 214 to coupled pinion gear 32 of the vehicle 10, which causes the connected rear axle 22 of the vehicle to rotate. Although a single pull of the draw string 236 energizes the rear axle 22, repeated pulling of the draw string 236 prior to releasing the toy vehicle 10 onto a surface can impart more rotational energy to the rear axle 22 and flywheel 30 and potentially to the rear drive wheel 28 and increase the rotational speed of the rear axle 22. The mechanism for transferring rotational energy from assembly 212 to vehicle 10 is further described with reference back to FIG. 3.

The draw string mechanism 212, in particular the main power gear 240 of mechanism 212, is connected to the unidirectional clutch 216 by way of an aperture 256 through the complementary half section 230 of housing 228. The unidirectional clutch 216 comprises arm member 258 having an aperture that is concentric with aperture 256 and that allows the insertion of the main power gear 240. The unidirectional clutch 216 further comprises a spring member 260, and a second arm 262 that has a first opening to receive an end of the pulley assembly axle 252, which is received in a journal 266 formed in the cover 218. An idler gear 264 is rotatably supported between arms 258, 262. The spring member 260 is arranged to pivot clutch 216 so that the gear 264 does not mesh with a first gear 268 of the gear train 214 when the main power gear 240 is in its "non-driving" condition and, conversely, allows the meshing between the gears 264 and 268 when the main power gear 240 is in its "driving" condition overcoming the bias of spring 260. More particularly, when the draw string 236 is not being pulled or is being released, the main power gear 240 is in its "non-driving" condition in which spring member 260 pivots clutch 216 and gear 264 away from gear 268. When the draw string 236 is being pulled, the main power gear 240 is in its "driving condition". The rotation of main power gear 240 simultaneously rotates idler gear 264 and pivots clutch 216, overcoming the spring bias of spring member 260, thereby allowing the driving engagement of gear 264 with gear 268.

The gear train 214 further comprises a gear 270 that meshes with gear 268, a gear 272 coupled with gear 270 which meshes with a gear 274 that is mated with a gear 276. Gear 276 is partially exposed through an opening 218A at a front end of housing 218 and, in turn, meshes with the exposed pinion 32 connected to the rear axle 22 (both indicated in phantom exploded view) of the toy vehicle 10. The gear 268, as well as each of the other gears of gear train 214, has a predetermined number of teeth so as to establish a gear ratio between the main power gear 240 and pinion 32 that allows the rear axle 22 to be rotated in an easy and rapid manner by the pulling of draw string 236. Shaft 278 supporting gears 274 and 276 is mounted between a journal (not depicted) in the complementary half section 230 of housing 228 and a journal 282 of the cover 218. Similarly, shaft 279 supporting gears 270 and 272 is maintained between a journal (not depicted) on half section 230 and a journal 284 on the cover 218. Gear 268 is fixed to shaft 280 which has an end received in a journal 286 of the cover 218 and an end which passes through housing section 230 into a journal (not depicted) on housing section 232. The cover 218 further has openings 288, 290, 292 and 294 into which are inserted screw members (not shown) so as to attach the cover 218 to the housing 228, in particular, to the complementary half section 230 of the housing 228.

Figure 5:
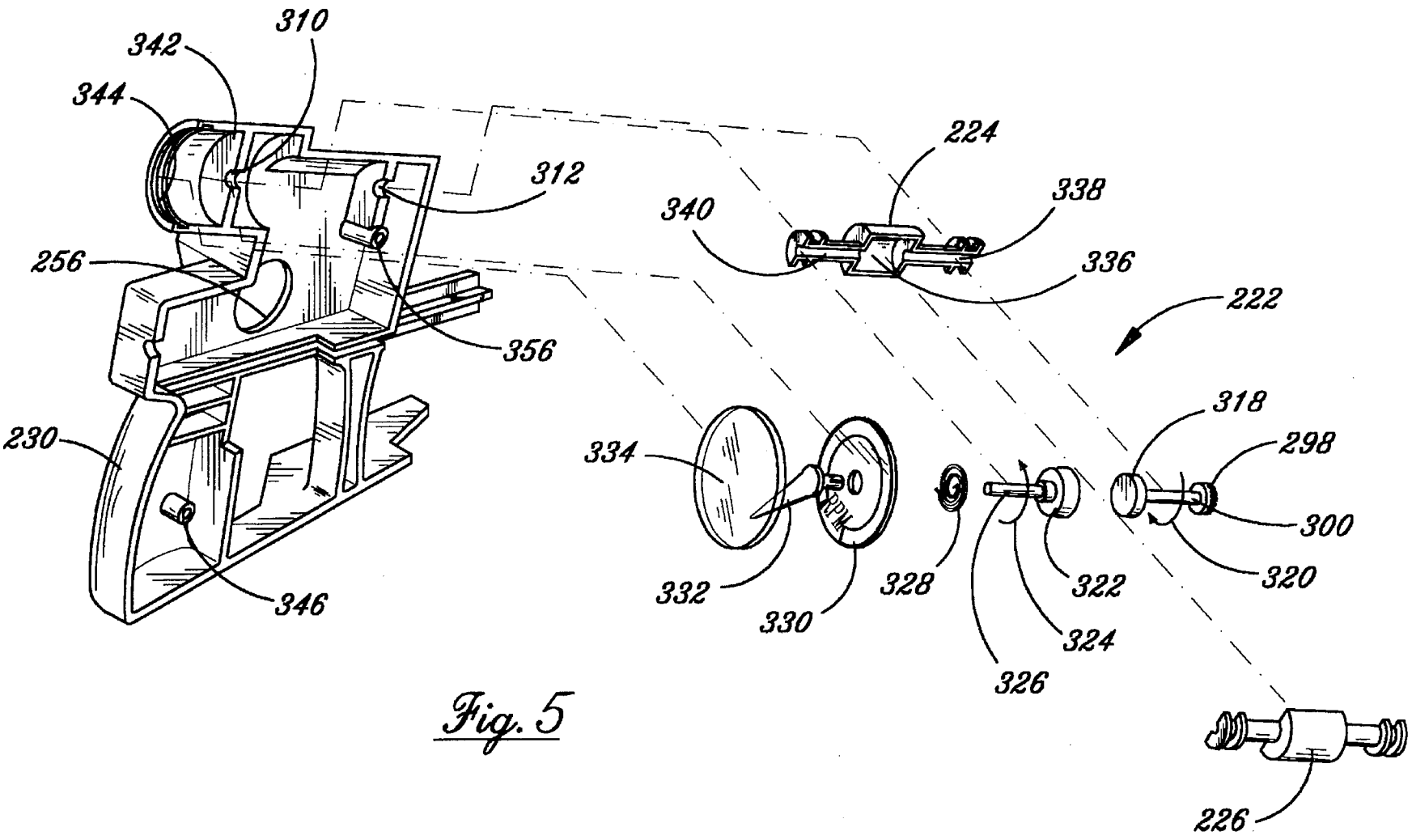
FIG. 5 is an exploded view illustrating details of a tachometer of FIG. 3.

The gear set 214 has a further gear 296 which is fixed to shaft 280 in housing 228 to rotate with gear 268. Gear 296 meshes with a crown gear 298 of the tachometer 222. Crown gear 298 is supported at an end of an input shaft 300 of the tachometer 222. The remainder of shaft is held by the complementary enclosure sections 224 and 226. The complementary section enclosure 224 has opposite ends 302 and 304 that respectively mate with opposite ends 306 and 308 of the complementary section enclosure 226. Further, the opposite end 302 mates with a cutout 310 of the complementary half section 230 and the opposite end 304 mates with a cutout 312 also of complementary half section 230, whereas the opposite end 306 mates with a cutout 314 of the complementary half section 232 and the opposite end 308 mates with a cutout (not shown) of the complementary half section 232 mirroring cutout 314. The tachometer 222 is further described with reference to FIG. 5.

The tachometer 222 comprises, in addition to input shaft 300 and crown gear 298, a magnet 318 is fixed to shaft 300, which rotates in a first direction 320 with shaft 300 and gear 298. A steel bell 322 is coupled to an output shaft 326 and an indicating needle 332. A needle return spring 328, a RPM graphics plate 330, and a lens cover 334 complete the tachometer 222. The magnet 318 is rotatably supported in the steel bell 322 by enclosure sections 224 and 226, in a cavity 336 (shown for the enclosure 224 but also present in enclosure 226), whereas the input shaft 300 and the output shaft 326 are respectively inserted into channels 338 and 340 (again shown only for the enclosure 224 but also present in enclosure 226).

In operation, the crown gear 298 is coupled to the exposed pinion 32 of the vehicle by way of gear 296 and gear set 214 including exposed drive gear 276, and "senses" the rotational speed of gear 296, which is directly proportional to the rotational speed of the rear axle 22. The crown gear 298 drives the input shaft 300 which, in turn, rotates the magnet 318. The rotation of magnet 318 is magnetically "sensed" by the steel bell 322 which rotates in an attempt to follow magnet 318 and, in turn causes shaft 326 to move with needle 332. Needle return spring 328 prevents free rotation of shaft 326. However, the magnetic coupling between rotating magnet 318 and steel bell 322 overcomes the bias of the needle return spring 328 so as to cause the indicating needle 332, connected to the shaft 326, to be rotated through an angle proportion to the speed of rotation of magnet 318. Thus, the degree of angular movement of needle indicator 332 is therefore directly related to the speed of the rotation of the rear axle 22. The RPM graphic plate 330 carrying the RPM indicia is placed in contact with a dish-like support plate 342 of half section 230 and a mirror plate portion of half section 232 (shown only in FIG. 3), whereas the lens cover 334 is mated with a lip 344 of both the complementary half section 230 and a mirror lip of section 232, the mirror lip not being shown in any of the figures.

Referring back to FIG. 3, the complementary half section 230 has a mounting boss 346, which is arranged to be in alignment with an opening 348 of the complementary half section 232 and is connected thereto, preferably by a screw (not shown), so that the sections 230 and 232 are connectably and matingly brought together. The complementary half section 232 further has fastener openings 350 and 352 with an opening 354 there between into which is inserted the rod 252 of the draw string mechanism 212 discussed with reference to FIG. 4. Screw members (not shown) are inserted into openings 350 and 352 so as to further fixedly secure together the half sections 230 and 232. Still further, the half sections 230 and 232 are mated together by means of guide mounting member 356 of section 230 that operatively cooperates with a complementary guide member (not shown) of section 232.

Figure 7:
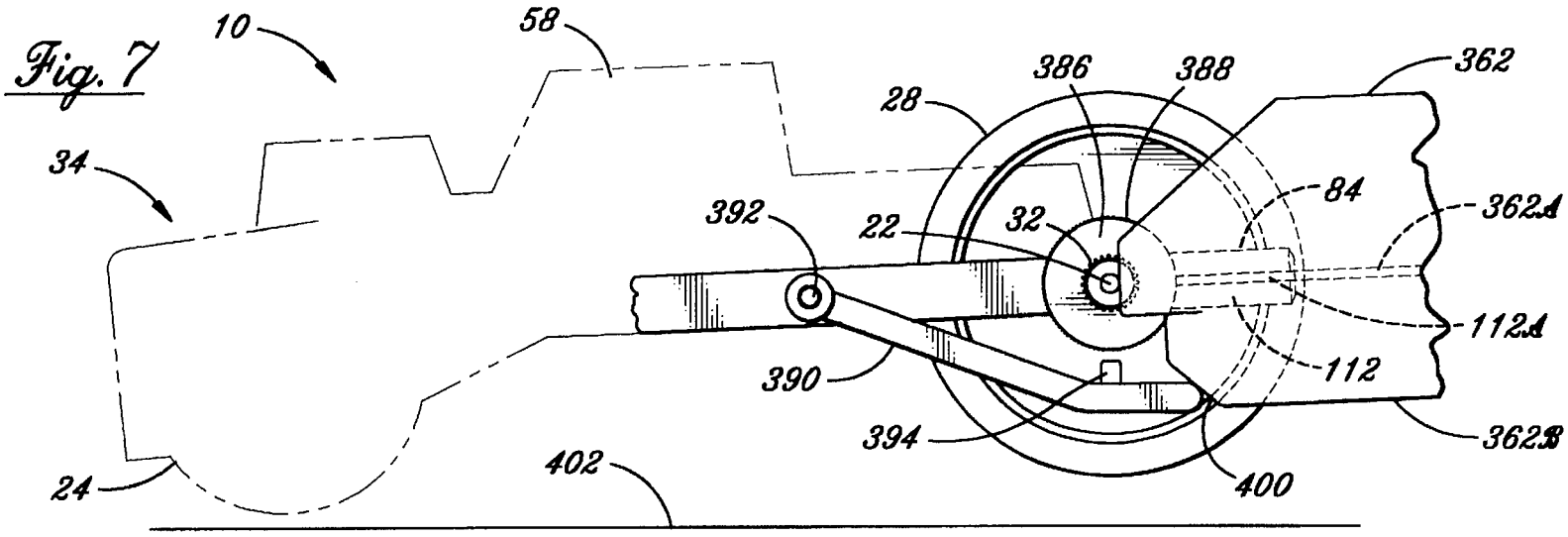
FIG. 7 is a schematic view illustrating the toy vehicle of FIG. 6 being held by the inertia energizer and launcher at an elevated position prior to release of the toy vehicle from the inertia energizer and launcher.

The housing 228 defines a yoke 358 with a pair of arms 360 and 362, which extend in parallel from a front end of a remainder of the launcher 210 and which are adapted to receive and hold the toy vehicle 10 so that the drive wheel 28 is free to rotate. Arms 360 and 362 preferably include prongs 360A and 362A, respectively, which are located to be inserted into slots 114A and 112A, respectively, of vehicle 10. The prongs 360A and 362A are elevated sufficiently above the surface supporting the housing 228 to raise the 10 drive wheel 28 from the support surface (as shown in FIG. 7) when the prongs 360A and 362A are respectively inserted into the slots 114A and 112A. The toy vehicle 10 is further held in place by the latch 92, already discussed with reference to FIG. 1, but which is considered to be part of the inertia energizer and launcher 210 of FIG. 3.

The latch 92 has transversely extending ends 364 and 366 that are respectively inserted into complementary journal openings in the housing 228 only one of which is indicated at 368, and which allow the latch 92 to pivot allowing hooks 102 and 104 to be inserted into and rotated out of detentes 88 and 90 of the chassis 14 of the toy vehicle 10. A central region 92A of latch 92 is operatively coupled to the movable trigger 220.

The movable trigger 220 comprises a longitudinal member 370 that has a cutout 372 in its undersurface that loops over and releasably engages the central region 92A of the latch 92. The movable trigger 220 further comprises a finger grippable surface 374, and a rearwardly extending stem 376 that inserts into an opening formed by both a groove 378 of the housing half section 230 and a mirror groove (not depicted) in the complementary housing half section 232. A spring 382 that biases trigger 220 forward is preferably inserted over the stem 376 before the stem 376 is mated with the complementary half sections 230 and 232.

In operation, the rear end of the toy vehicle 10 is positioned between launcher arms 360, 362 such that the slots 112A and 114A (see FIG. 1) receive prongs 362A and 360A of arms 362 and 360 respectively. As the prongs 360A and 362A are inserted into slots 114A and 112A, respectively, they engage the springs 110 in the chassis 14 (see FIG. 1), thereby compressing the springs 110 to store potential energy or a force. The springs 110 are maintained in compression by engagement of the hooks 102 and 104 respectively with the detentes 88 and 90 (see FIG. 1). This potential energy is maintained until the movable trigger 220, in particular the trigger grippable portion 374, is moved rearward (as viewed in FIG. 3), causing a pivoting of latch 92 so that the arms 98 and 100 are rotated and the hooks 102 and 104 are raised out of their respective detentes 88 and 90. The springs 110, thus released, expand and catapult the toy vehicle 10 away from the inertia energizer and launcher 210 and in its aimed direction established by the child positioning the inertia energizer and launcher 210. In one embodiment of the invention, the catapulting of toy vehicle 10 creates a sparking effect which is further described with reference to FIG. 6.

Figure 6:
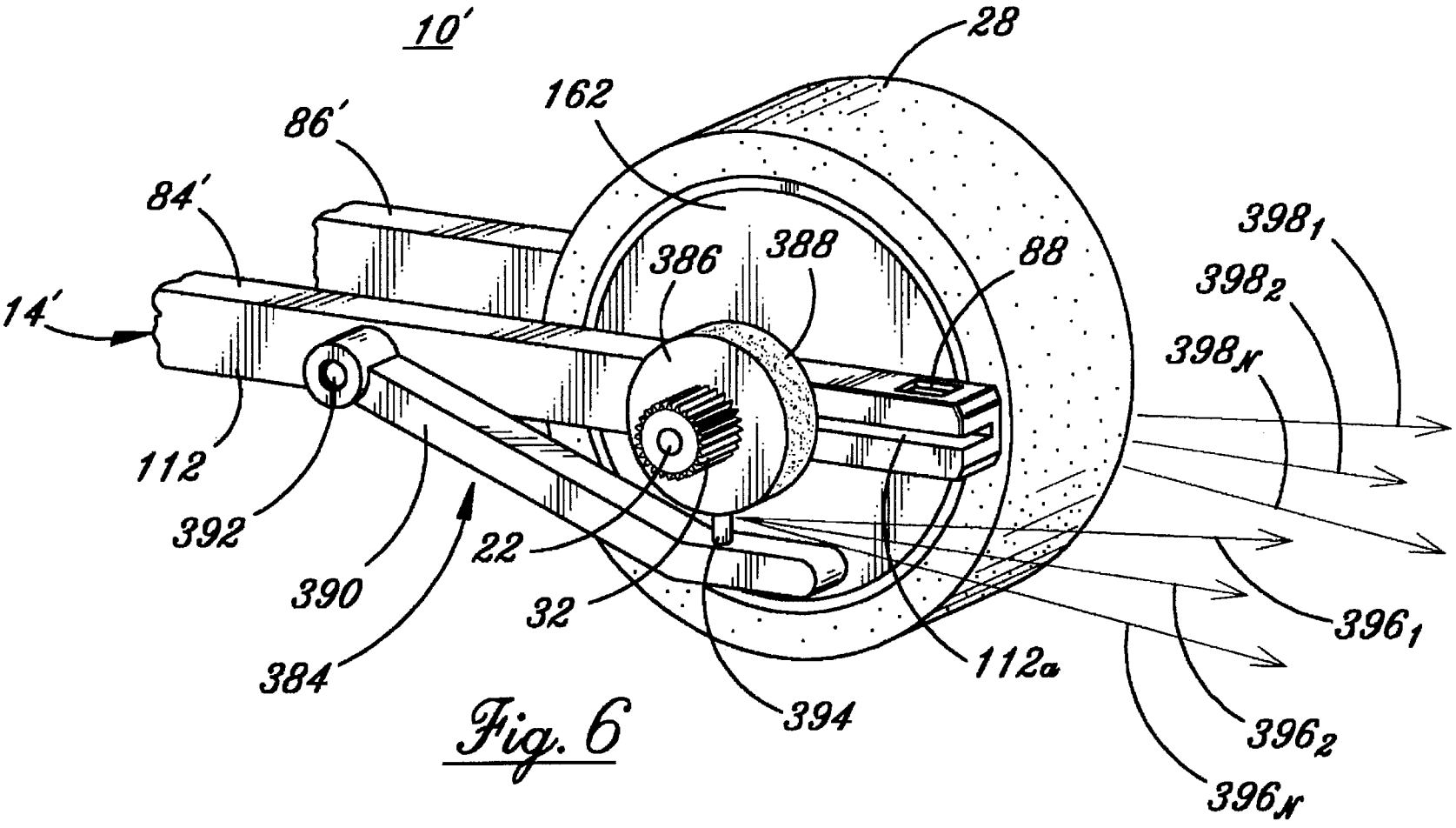
FIG. 6 is a perspective view that illustrates an embodiment that generates sparks during the movement of a drive wheel of a toy vehicle of the present invention.

FIG. 6 illustrates a chassis and drive wheel portion of a toy vehicle embodiment indicated generally at 10', which has been modified by the provision of an assembly indicated generally at 384 that generates visible sparks when the toy vehicle 10' is moving in a forward direction. The spark generating assembly 384 comprises a circular wheel 386, which is fixed to the rear axle 22 and has an abrasive outer surface 388. The spark generating assembly 384 further comprises an arm 390 that pivots about a joint 392 attached to arm 84' of the vehicle chassis 14'. The assembly 384 further comprises a material 394, such as a flint, at one end of arm 390, the free end, that generates sparks $396_1$, $396_2$ . . . $396_N$ when rubbed on the outer surface 388. A torsional coil spring (not depicted) or other conventional bias member is coupled between the arm 84' and the arm 390 so as to bias the one free end of arm 390 against the abrasive outer surface 388. The same elements of embodiment 384 can be located on the opposite side of the toy vehicle 10' shown in FIG. 6., to generate sparks $398_1$, $398_2$ . . . $398_N$ shown in FIG. 6. The arm 390 is arranged to pivot about joint 392 sufficiently to provide at least two spaced apart positions shown in FIGS. 7 and 8, respectively, with the material 394 arranged to be spaced from the abrasive surface 388 in the first position of FIG. 7, and to engage with the abrasive surface 388 in the second position of FIG. 8 so as to generate the spark $396_1$ . . . $396_N$. This description is equally applicable to the oppositely located embodiment (not shown), if provided.

As seen in FIG. 7, the one end of the arm 390 that carries the flint 394, the free end, is arranged so as to be cammed away from contacting the abrasive outer surface 388 by an inclined section 400 of the lower portion 362B of the arm 362 that forms one part of the vehicle receiving yoke 358 of inertia energizer and launcher 212 previously discussed with reference to FIG. 3. As further seen in FIG. 7, the prong 362A of arm 362 is inserted into the slot 112A of the toy vehicle 10' which, as previously mentioned, lifts the drive wheel 28 (FIG. 2) to prevent the drive wheel 28 from contacting support surface 402 and causes the drive wheel 28 to be elevated higher than the front wheels 24. Further, the front wheels 24 are also preferably though not necessarily elevated above the support surface 402 on which the toy vehicle 10 ultimately rides and on which the inertia energizer and launcher 212 rests. The pistol grip 230*a*/232*a* allows the user to move and aim the launcher 210 with mounted vehicle 10 like a weapon and to accelerate the flywheel and drive wheel without resting the launcher on a support surface.

Figure 8:
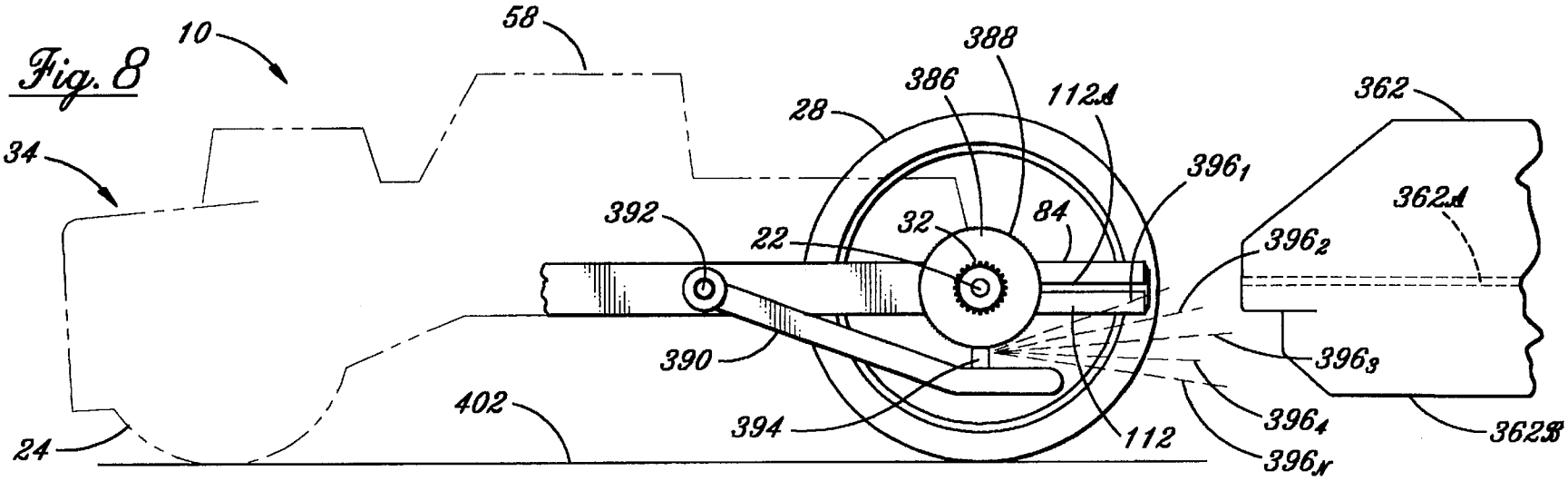
FIG. 8 is a schematic view illustrating the release and catapulting of the toy vehicle from the inertia energizer and launcher.

All that is required to catapult the vehicle 10 (or 10') is for the movable trigger 220 (see FIG. 4) to be depressed which, in turn, releases the latch 92 from the toy vehicle 10 and releases the force of the prongs 360A, 362A against the compressed springs 110. The toy vehicle 10 is catapulted by springs 110 from the inertia energizer and launcher 210 in its selected direction. Furthermore, the elevated position of the drive wheel 28, allows the draw string 236 to be repeatedly pulled so that the speed of the rear axle 22 is raised incrementally to a desired relatively high RPM prior to depression 104 the movable trigger 220. Rotation of the rear axle 22 which, in turn, rotates the flywheel 30 causes the rotation of the drive wheel 28 through the pawls. However, as previously described, the coupling between the flywheel 30 and drive wheel 28 is dependent upon the magnitude of the torque to be transferred between the pawls of clutch members $\mathbf{142}_1$ and $\mathbf{142}_2$ and the textured surface 152 of the flywheel 30. If that torque is sufficiently low in magnitude, the distal ends 148 and 150 of the flexible pawls of clutch members $\mathbf{142}_1$ and $\mathbf{142}_2$ will engagingly and drivingly contact the textured surface(s) 152 to transfer torque to the textured surface 152. When the movable trigger 220 is squeezed, the vehicle 10' (or 10) is catapulted from the launcher 212 onto surface 402 as further shown with reference to FIG. 8. As seen in FIG. 8, not only are the front wheels 24 and rear drive wheel 28 contacting the surface 402, but also, the flint 394 is contacting the abrasive surface 388, thereby, causing the generation of sparks $\mathbf{396}_1, \ldots \mathbf{396}_N$.

It should now be appreciated that the practice of the present invention provides for an inertia energizer and launcher 210 that cooperates with the toy vehicle 10 to cause the toy vehicle 10 to be easily powered and then released and catapulted therefrom. More importantly for entertainment value, the launcher 210 and vehicle 10 can be used by a child as a projectile launching toy, like a toy weapon, even while the child is running about. The inertia energizer and launcher 210 also undergoes a recoil when a vehicle is launched further enhancing the "weapon" simulation of the combination. The combination is also safer than conventional projectile launching toys in that the vehicle need only be thrown sufficiently to clear the launcher and to accelerate the vehicle so there is no excessive slippage and power loss between the drive wheel and the flywheel when the drive wheel hits the ground. By virtue of its flywheel stored energy, the vehicle will continue to streak along the ground a significant distance to its intended target. Propelling the vehicle along the ground for most of its range of action significantly reduces the likelihood of any possible injury. The front end of the vehicle can be made blunt by suitably shaping the body and /or bumper of the vehicle for further protection.

It should be further appreciated that the release of the toy vehicle from the inertia energizer and launcher 210 may be synchronized by the user with a preselected speed indicated by the tachometer 222 and created by the repetitive pulling of the draw string 236 of the draw string mechanism 212.

Still further, it should be appreciated that the practice of the present invention provides the pinion 32 to be directly coupled either to the drive wheel 28 or to the flywheel 30 but not both.

Further, the present invention provides a flexible coupling between the drive wheel and flywheel in all of its vehicle embodiments so that the drive wheel may be grasped by a child without causing any abrasions to the child or even alarming the child to make him/her drop the captured toy vehicle 10.

It will be appreciated by those skilled in the art that changes and modifications may be made to the above described embodiments without departing from the inventive concept thereof. For example, if desired, the pistol grip and draw string handle could be replaced by an equivalent mechanism such as a two-handed pump action energizer/launcher with a pair of hand gripping surfaces which are longitudinally spaced apart and which can be separated and brought together in a reciprocating motion equivalent to the motion repeatedly pulling and relaxing the draw string vehicle holding the launcher with the pistol grip. Also, while the vehicle launch springs 110 are disclosed as being mounted within the chassis of the vehicle, the springs 110 could as easily be mounted in the arms 360, 362 of the energizer/launcher while prongs 360A and 362A could be provided on the vehicle chassis (or body) to compress the launcher springs in an equivalent manner. Nor is the invention limited to coil springs to bias the vehicle away from the energizer/launcher. Other types of springs, elastameric members and other bias members known in the art might be used. It is understood, therefore, that the present invention is not limited to the particular embodiments disclosed, but is intended to include all modifications and changes which are within the scope and spirit of the invention as defined by the appended claims.

What I claim is:

1. A toy vehicle comprising:

(a) a rotatably mounted axle;

(b) at least one drive wheel mounted on said axle for rotation;

(c) a flywheel mounted on said axle for rotation and disposed within said one drive wheel;

(d) only one of the drive wheel and the flywheel being fixed to the axle so as to rotate as one with the axle; and (e) a slip clutch drivingly coupling together the drive wheel and the flywheel, the slip clutch including a flexible pawl on one of the drive wheel and the flywheel extending from the one of the drive wheel and the flywheel to and being biased against a remaining one of the drive wheel and the flywheel and a surface of the remaining one of the drive wheel and the flywheel extending generally radially with respect to the axle, the surface being fixed with a remainder of the remaining one of the drive wheel and the flywheel, the surface being contacted by the biased, flexible pawl and being engaged by contact with the biased, flexible pawl to releasably drivingly couple together the flywheel and the drive wheel.

2. The toy vehicle according to claim 1, wherein the at least one flexible arm and the textured surface are selected so that the clutch member serves as a sonorous device as the flexible arm sweeps across the textured surface.

3. The toy vehicle according to claim 1 wherein the at least one clutch member is fixedly coupled to the drive wheel.

4. The toy vehicle according to claim 3 wherein the flywheel is fixedly coupled with the axle.

5. The toy vehicle according to claim 1, wherein said drive wheel is connected to said axle by a hub which is also connected to said flexible clutch arm.

6. The toy vehicle according to claim 1 further comprising a wheel having an abrasive outer surface and fixed to the axle and a second pivotable arm having one end biased against the abrasive surface and a material at the one end that produces a spark when engaged by the abrasive surface.

7. The toy vehicle according to claim 1 wherein the surface is textured sufficiently to be drivingly engaged by the flexible pawl when a torque of a sufficiently low magnitude is transmitted between the pawl and textured surface and to allow the pawl to slip over the textured surface when a torque of sufficiently great magnitude is transmitted from one of the flexible pawl and the textured surface to the remaining one of the flexible pawl and the textured surface.

8. A mechanical clutch rotatably connecting and disconnecting an associated flywheel and drive wheel on a toy vehicle, the mechanical clutch comprising:

a flexible pawl on one of the drive wheel and the flywheel extending from the one of the drive wheel and the flywheel to and biased against the remaining one of the drive wheel and the flywheel; and an at least generally radially extending surface at least fixedly coupled with a remainder of the remaining one of the drive wheel and the flywheel, the surface being textured sufficiently to be drivingly engaged by the biased, flexible pawl when a torque of a sufficiently low magnitude is transmitted between the pawl and the textured surface and to allow the pawl to slip over the textured surface when a torque of a sufficiently great magnitude is transmitted from one of the flexible pawl and the textured surface to the remaining one of the flexible pawl and the textured surface.

9. The clutch according to claim 8 wherein the drive wheel is rotatably mounted on an axle and wherein the flywheel is fixedly secured to the axle and is located within the drive wheel.

10. The clutch according to claim 8 wherein the flywheel bears the textured surface.

* * * * *